US009537239B1

(12) United States Patent
Liu et al.

(10) Patent No.: US 9,537,239 B1
(45) Date of Patent: Jan. 3, 2017

(54) ORTHOGONAL TYPE BACKPLANE CONNECTOR AND COMBINATION TYPE CARD-PLUGGED CONNECTOR

(71) Applicant: Amphenol Commercial Products (ChengDu) Co.LTD, Chengdu (CN)

(72) Inventors: Xiaogang Liu, Shenzhen (CN); Rongzhe Guo, Chengdu (CN)

(73) Assignee: Amphenol Commercial Products (ChengDu) Co. LTD, Chengdu (CN)

( * ) Notice: Subject to any disclaimer, the term of this patent is extended or adjusted under 35 U.S.C. 154(b) by 0 days.

(21) Appl. No.: 14/953,004

(22) Filed: Nov. 26, 2015

(30) Foreign Application Priority Data

Aug. 25, 2015 (CN) ..... 2015 1 0525609 A
Aug. 25, 2015 (CN) ..... 2015 2 0645080 U

(51) Int. Cl.
*H01R 13/6587* (2011.01)
*H01R 12/70* (2011.01)
*H01R 25/00* (2006.01)

(52) U.S. Cl.
CPC ..... *H01R 12/7076* (2013.01); *H01R 25/00* (2013.01)

(58) Field of Classification Search
CPC ... H01R 13/6587; H01R 23/722; H01R 9/096; H01R 23/688; H01R 13/514; H01R 13/6586
USPC ..... 439/65, 607.07, 607.06
See application file for complete search history.

(56) References Cited

U.S. PATENT DOCUMENTS 6,814,619 B1 * 11/2004 Stokoe ..... H01R 13/6587 439/108
7,722,400 B2 * 5/2010 Bixler ..... H01R 12/716 439/607.07
7,824,197 B1 * 11/2010 Westman ..... H01R 13/6586 439/108
7,862,376 B2 * 1/2011 Sypolt ..... H01R 12/585 439/607.07
7,967,638 B1 * 6/2011 Kline ..... H01R 12/7082 439/607.07
8,398,432 B1 * 3/2013 McClellan ..... H01R 13/6587 439/607.07
8,591,257 B2 * 11/2013 Girard ..... H01R 13/6473 439/607.07
8,864,521 B2 * 10/2014 Atkinson ..... H01R 13/6471 439/607.07

(Continued)

*Primary Examiner* — Gary Paumen
(74) *Attorney, Agent, or Firm* — Gokalp Bayramoglu

(57) ABSTRACT

This invention discloses an orthogonal type card edge connector and a combination type card-plugged connector. The orthogonal type card edge connector includes a terminal component for transmitting current signal and/or current and a shell component for accommodating the terminal component. The terminal component comprises a first contact part and a second contact part, a spur line of the first contact part is orthogonal or parallel to a spur line of the second contact part. After the terminal component is electrically connected to a first circuit board and a second circuit board, the first contact part and the second connect part are separately connected with the first circuit board and the second circuit board, which are separately orthogonal and parallel to an extend surface of the orthogonal type card edge connector. The combination type card-plugged connector comprises at least two orthogonal type card edge connectors which are assembled together.

8 Claims, 5 Drawing Sheets

(56) References Cited

U.S. PATENT DOCUMENTS

| | | | | |
|---|---|---|---|---|
| 8,888,531 | B2 * | 11/2014 | Jeon | H01R 13/65807 439/607.07 |
| 8,961,227 | B2 * | 2/2015 | Gailus | H01R 13/26 439/607.07 |
| 2005/0032430 | A1 * | 2/2005 | Otsu | H01R 23/688 439/607.07 |
| 2006/0014433 | A1 * | 1/2006 | Consoli | H01R 13/6485 439/607.07 |
| 2009/0291593 | A1 * | 11/2009 | Atkinson | H01R 13/6471 439/607.06 |
| 2010/0144204 | A1 * | 6/2010 | Knaub | H01R 13/514 439/607.07 |
| 2013/0102192 | A1 * | 4/2013 | Davis | H01R 23/688 439/607.07 |
| 2013/0217263 | A1 * | 8/2013 | Pan | H01R 13/6474 439/607.07 |

* cited by examiner

ORTHOGONAL TYPE BACKPLANE CONNECTOR AND COMBINATION TYPE CARD-PLUGGED CONNECTOR

TECHNICAL FIELD OF THE INVENTION

This disclosure relates to a signal/power transmission device, specifically relates to a combination type card-plugged connector.

BACKGROUND

In existing technology, when connecting two orthogonal circuit boards, male connector is connected with one circuit board, a female connector is connected with another circuit board, then the signal can be transmitted between the two circuit boards by connecting the male connector and the female connector together. During installing the circuit boards, a plurality of connectors are used, which requires more installation space and more signal conversion steps, and increases the cost of the connector.

SUMMARY OF THE INVENTION

According to the insufficiency of the existing technology, this disclosure provides an orthogonal type card edge connector and a combination type card-plugged connector, which can connect with two orthogonal circuit boards directly through one card edge connector.

To achieve the purpose stated above, the technical proposal of the disclosure is below:

First, an orthogonal type card edge connector is provided. The orthogonal type card edge connector comprises a terminal component configured to transmit electrical signal and/or current, and a shell component configured to accommodate the terminal component. The two ends of the terminal component comprises a first contact part and a second contact part. The spur line of the first contact part is orthogonal or parallel to the spur line of the second contact part. After the terminal component is electrically connected to the first circuit board and the second circuit board, the first connect part and the second connect part are connected with the first circuit board and the second circuit board with extending surfaces orthogonal to or parallel to each other respectively.

Second, a combination type card-plugged connector is provided. The combination type card-plugged comprises at least two orthogonal type card edge connectors. The at least two orthogonal type card edge connectors are assembled together. The orthogonal type card edge connector comprises a terminal component configured to transmit electrical signal and/or electricity, and a shell component configured to accommodate the terminal component. Two ends of the terminal component comprises a first contact part and a second contact part. The spur line of the first contact part is orthogonal or parallel to the spur line of the second contact part. After the terminal component is connected to the first circuit board and the second circuit board, the first contact part and the second contact part are connected with the first circuit board and the second circuit board with extending surfaces orthogonal to or parallel to each other respectively.

The beneficial effects of the disclosure is below:

During the connection of two orthogonal circuit boards, the first contact part and the second contact part of the terminal component are separately connected with one circuit broad. Two orthogonal circuit boards can be connected together through one connector, which breaks the restriction of the traditional connection way with male end and female end, thus, the step of signal conversion between two connectors can be omitted, and the use of the connectors, the cost and the assembly time can be reduced, therefore, production efficiency can be improved.

When in use, user can combine a plurality of orthogonal type card edge connectors together as needed to make a combined connector to transmit more signals, which is flexible in using occasions.

The structure with the orthogonal type card edge connector is more compact, which helps to miniaturize the connector. The orthogonal connection with circuit board greatly decreases the installation space.

Figure 1:
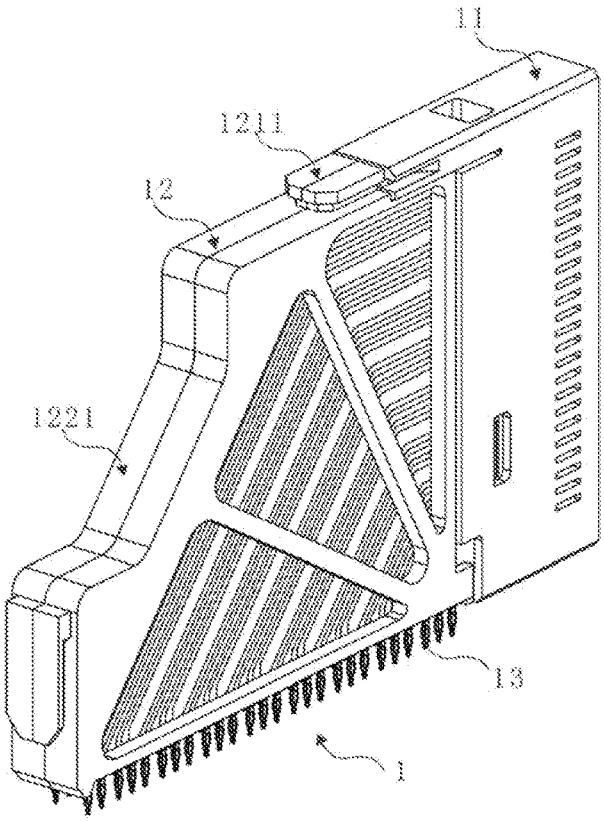
FIG. 1 is a structural diagram of one embodiment of an orthogonal type card edge connector.

Wherein, orthogonal type card edge connector 1,
base 11,
shell component 12,
first shell 121,
connection part 1211,
second shell 122,
groove 1221,
terminal component 13,
first terminal substrate 131,
first conductive plastic 1311,
second terminal substrate 132,
first contact part 1321,
current transmission contact point 1322,
second contact part 1323,
lead guide plate 14,
clamping plate 15,
first circuit board 2,
second circuit board 3.

DETAILED DESCRIPTION OF THE INVENTION

The embodiments of the invention are described below to get a better understanding for one skilled in the art. This disclosure is not limited to the embodiments; any variations of the invention in the scope of the claims and within the spirit of the invention are obvious, and within the scope of protection of the invention.

According to FIG. 1, FIG. 1 is a structural diagram of the orthogonal type card edge connector 1. In FIG. 1, orthogonal type card edge connector 1 comprises a terminal component 13 used to transmit electrical signal and/or electricity, and a shell component 12 used to accommodate terminal component 13. Terminal component 13 comprises a first contact part 1321 and a second contact part 1323 located on different ends. The spur line of first contact part 1321 is orthogonal to or parallel to the spur line of second contact part 1323.

First contact part 1321 and second contact part 1323 are located at the two ends of terminal component 13; first contact part 1321 and second contact part 1323 can respectively connect with a circuit board. The process of electrical connection between two circuit boards can be achieved by one connector. The restriction of the connection way with male end and female end is broken. In this invention, the step of signal conversion between two connectors can be omitted, and the use of the connectors, the cost, and the assembly time can be reduced; therefore, production efficiency can be improved.

First contact part 1321 mentioned above and below is a contact spring pin, which can be connected with external printed circuit board (PCB) including single board or card edge. Thus, the step of signal conversion between two connectors is omitted, which breaks the restriction of the connection way with male end and female end, thus, making the connection more stable and reliable, and decreasing the cost and improving production efficiency.

Second contact part 1323 mentioned above and below is a compression pin. Each compression pin has a fisheye structure, which greatly improves the rigidity of the pin.

Figure 8:
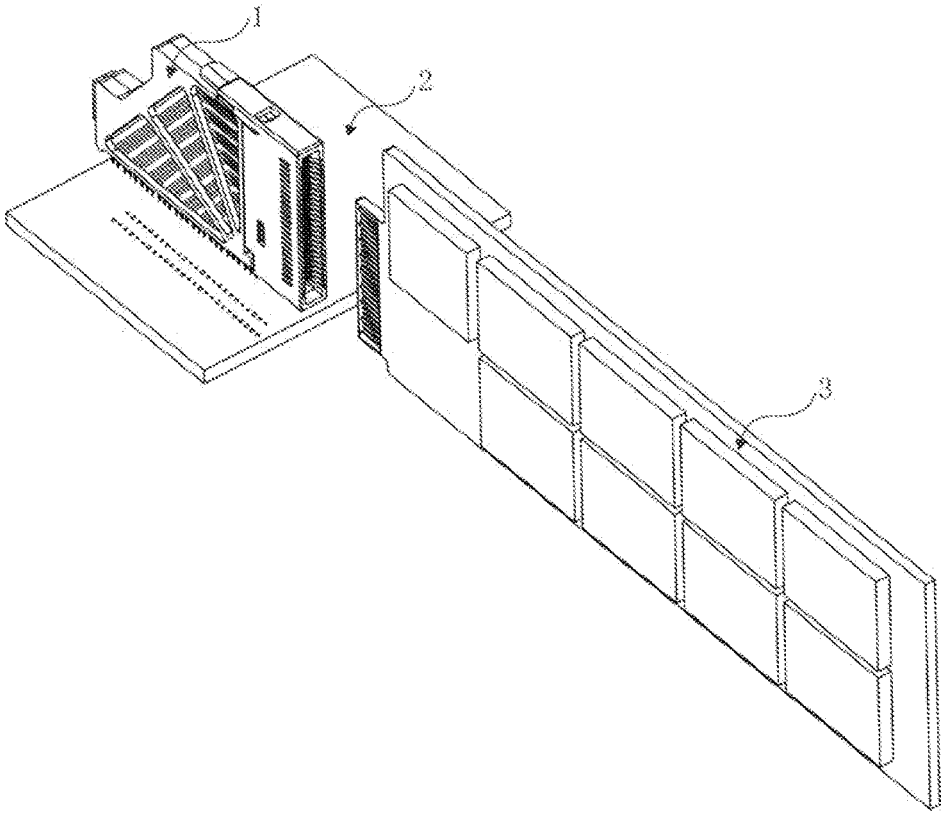
FIG. 8 is a structural diagram of the assembly of the orthogonal type card edge connector, a first circuit board and a second circuit board.

According to FIG. 8, FIG. 8 shows a structural diagram of the assembly of an orthogonal type card edge connector 1, a first circuit board 2 and a second circuit board 3. Terminal component 13 electrically connects to first circuit board 2 and second circuit board 3. First connect part 1321 and second connect part 1323 are connected with first circuit board 2 and second circuit board 3 with extending surfaces orthogonal to or parallel to each other respectively.

The structure with orthogonal type card edge connector 1 is more compact, which helps to miniaturize the connector. The orthogonal connection with circuit board greatly decreases the installation space.

Figure 9:
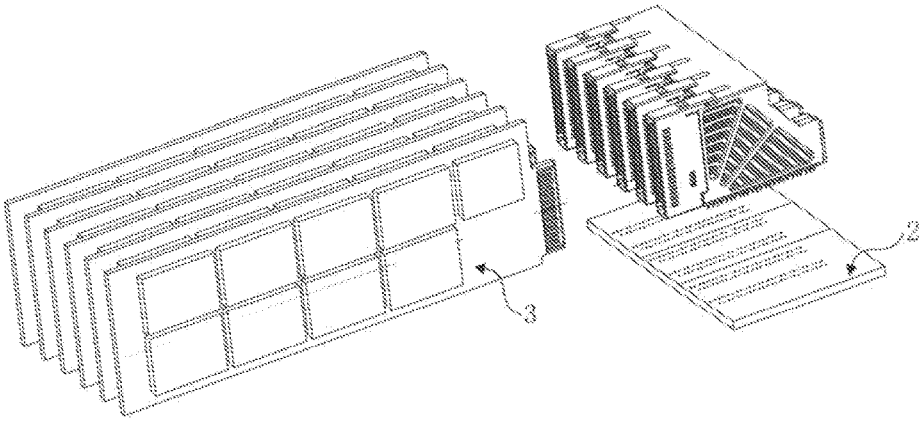
FIG. 9 is a structural diagram of the assembly of a combination type card-plugged connector, a first circuit board and a second circuit board.
Figure 10:
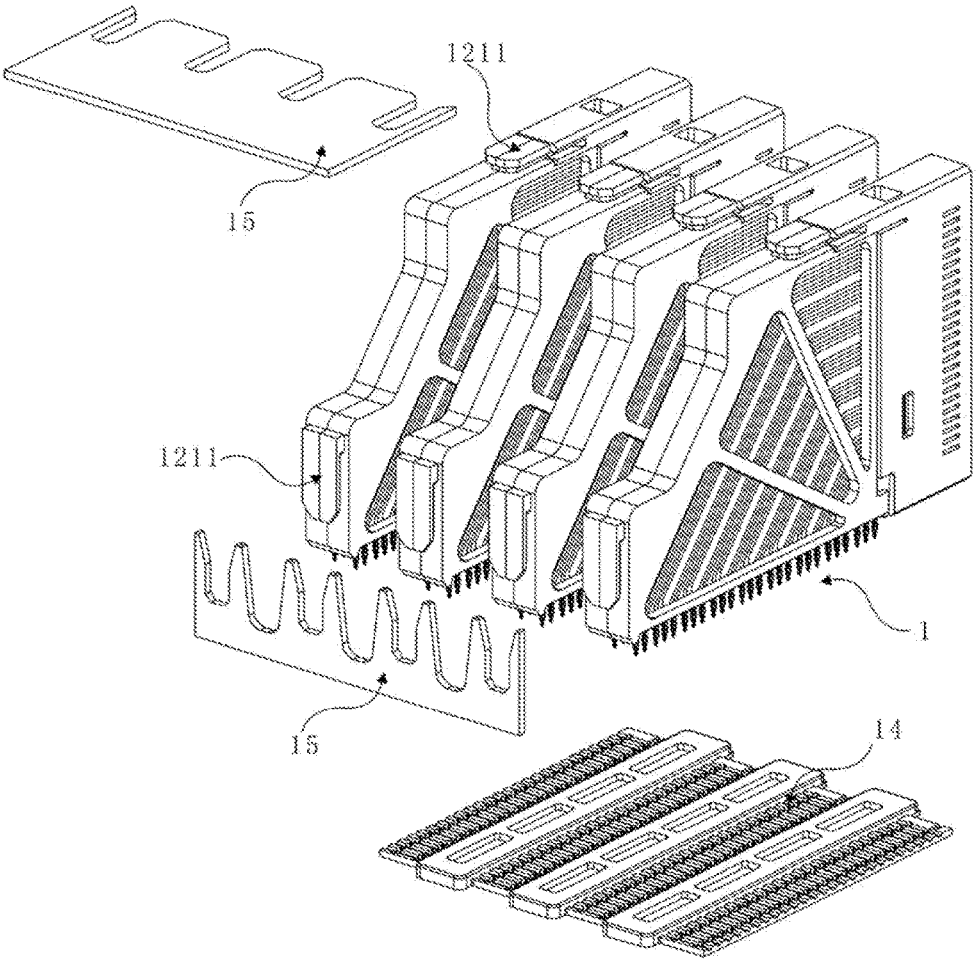
FIG. 10 is a structural diagram of the assembly of four orthogonal type card edge connectors, a lead guide plate, and a clamping plate.

According to FIG. 9 and FIG. 10, FIG. 9 shows a structural diagram of the assembly of a combination type card-plugged connector, a first circuit board 2 and a second circuit board 3. FIG. 10 shows a structural diagram of four orthogonal type card edge connectors, a lead guide plate and a clamping plate.

As shown in FIG. 9 and FIG. 10, the combination type card-plugged connector comprises at least two orthogonal type card edge connectors. Orthogonal type card edge connector 1 comprises a terminal component 13 configured to transmit electrical signal and/or electricity, and a shell component 12 configured to accommodate terminal component 13. Two ends of terminal component 13 comprises a first contact part 1321 and a second contact part 1323. The spur line of first contact part 1321 is orthogonal or parallel to the spur line of second contact part 1323.

The combination type card-plugged connector can be assembled optionally as needed when in use. Several orthogonal type card edge connectors 1 can be assembled by the following structure: as shown in FIG. 10, connection parts 1211 are located on upper end face and/or front end face of the shell component and at least two orthogonal type card edge connectors 1 are fixedly connected together through clamping plate 15 clamped on the connection part 1211.

The structure of clamping plate 15 which clamps the front faces of orthogonal type card edge connectors 1 is a bit different than the structure of clamping plate 15 which clamps the upper faces of orthogonal type card edge connectors 1.

Figure 2:
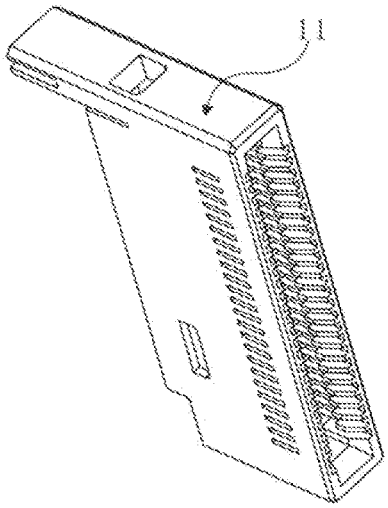
FIG. 2 is a stereoscopic view of a base.

In another embodiment of the invention, to ensure the stability after all the orthogonal type card edge connectors are assembled together, as shown in FIG. 2 and FIG. 10, a base 11 is installed at an end, away from groove 1221 of orthogonal type card edge connector 1 to fix first shell 121 and second shell 122 together. Specifically, base 11 is installed at the same side of first contact part 1321.

Figure 3:
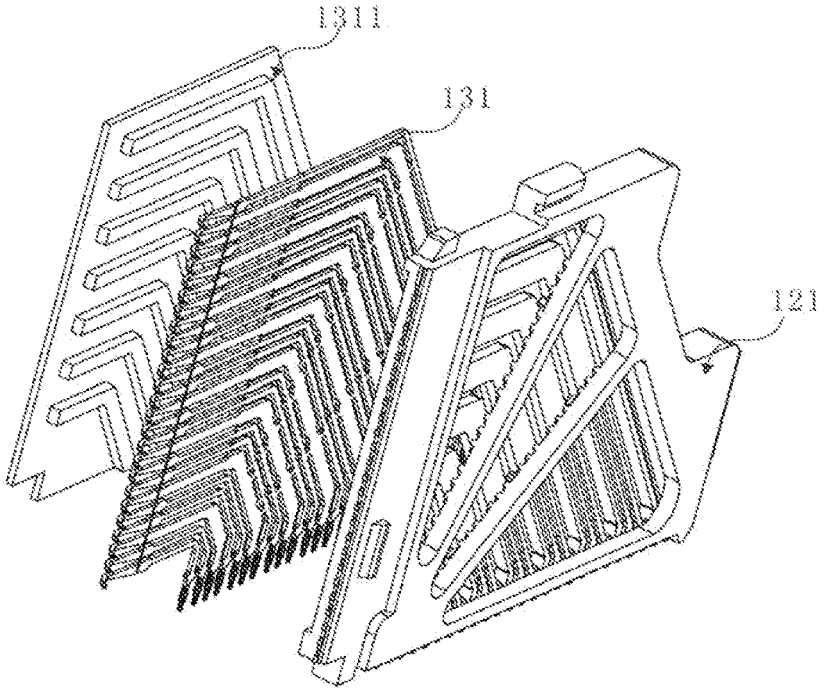
FIG. 3 is a structural diagram of the assembly process of a first shell, a first terminal substrate and a first conductive plastic.
Figure 5:
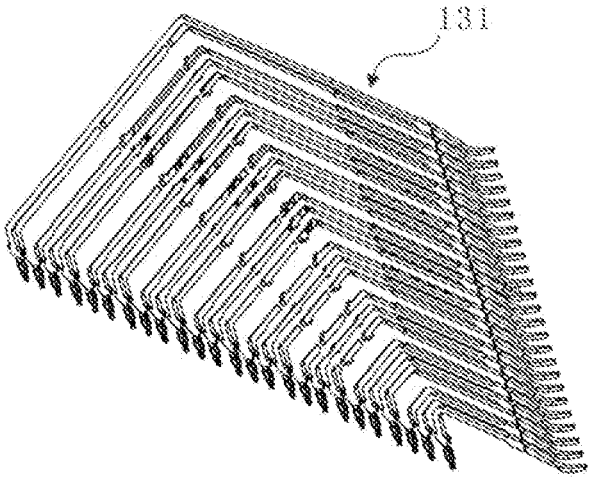
FIG. 5 is a stereogram of the first terminal substrate.
Figure 7:
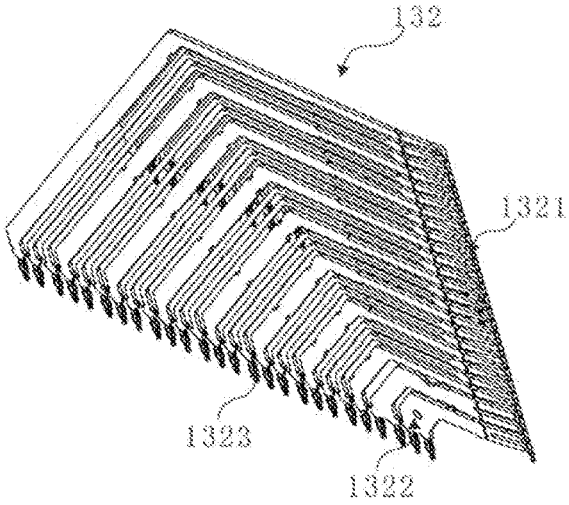
FIG. 7 is a stereogram of a second terminal substrate.

In one embodiment, terminal component 13 comprises at least one terminal substrate. As shown in FIG. 3, FIG. 5 and FIG. 7, the terminal substrate is equidistantly arranged with a plurality of conductor groups. Two ends of each conductor group are electrically connected with first contact part 1321 and second contact part 1323 respectively.

As shown in FIG. 10, a lead guide plate 14 is installed at the low end of orthogonal type card edge connector 1 to fix first shell 121 and second shell 122 together. Specifically, lead guide plate 14 is installed at the side of second contact part 1323. After being connected to second contact part 1323, lead guide plate 14 plays a role of shield effect to prevent electromagnetic interference.

In another embodiment of the invention, terminal component 13 comprises at least two terminal substrates with different layout structures. As shown in FIG. 3, FIG. 5 and FIG. 7, two terminal substrates are equidistantly arranged with a plurality of conductor groups. Two ends of conductor group are electrically connected with first contact part 1321 and second contact part 1323.

The two terminal substrates comprise a first terminal substrate 131 and a second terminal substrate 132. First contact part 1321 and second contact part 1322 of first terminal substrate 131 and second terminal substrate 132 both comprise a plurality of current transmission contact points 1322 and/or signal transmission contact points for current transmission.

First contact part 1321 and second contact part 1323 can set with current transmission contact point 1322 and signal transmission contact point optionally according to different needs. After setting optionally, terminal component 13 comprising first terminal substrate 131 and second terminal substrate 132 can realize the functions of current transmission, signal transmission, or both current and signal transmission.

The layout structures of at least two terminal substrates are different in width of the conductor groups, gap between conductor groups, quantity of conductors in conductor groups and/or gap between conductors in conductor groups. Preferably, the width of conductor groups connected with current transmission contact points 1322 is wider than the width of conductor groups connected with signal transmission contact points.

Figure 4:
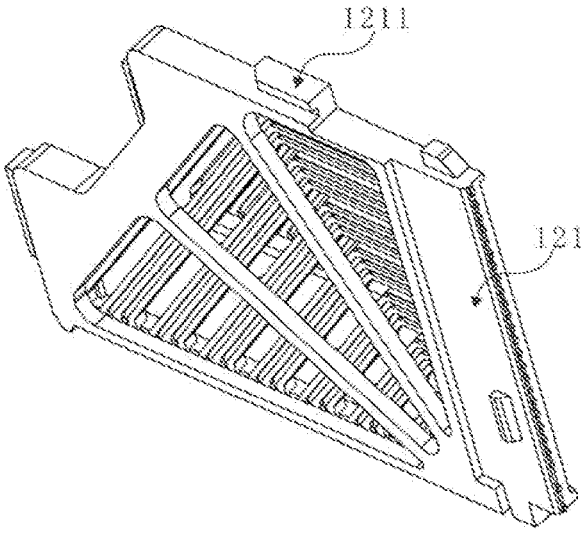
FIG. 4 is a stereogram of the first shell.
Figure 6:
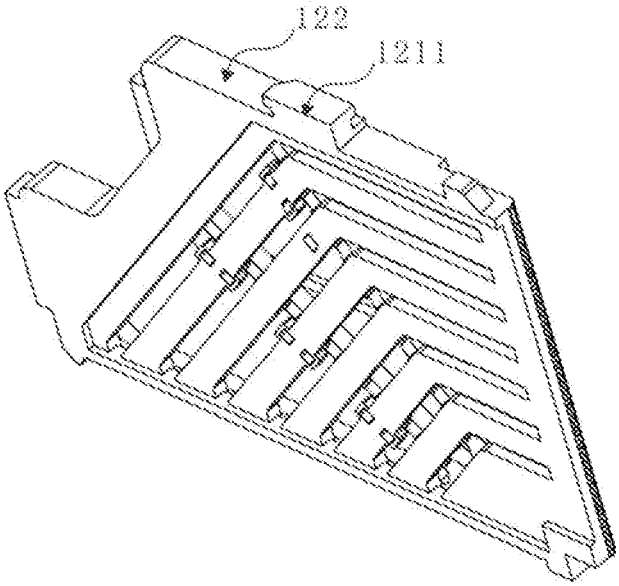
FIG. 6 is a stereogram of a second shell.

As shown in FIG. 3, FIG. 4 and FIG. 6, in one embodiment of the invention, shell component 12 comprises a certain quantity of shell parts which matches the quantity of terminal substrates. Shell parts comprise first shell 121 for installing first terminal substrate 131 and second shell 122 for installing second terminal substrate 132.

In actual production, preferably, first terminal substrate 131 and second terminal substrate 132 are initially produced. Then, first terminal substrate 131 and second terminal substrate 132 are installed into corresponding molds. First shell 121 forms on the surface of first terminal substrate 131 through an injection method wherein first shell 121 covers first terminal substrate 131. Second shell 122 forms on the surface of second terminal substrate 132 through an injection method wherein second shell 122 covers second terminal substrate 132.

As shown in FIG. 2, in another embodiment of the invention, to make sure that first shell 121 and second shell 122 are firmly fixed with each other, a base 11 is installed at an end away from groove 1221 to fix first shell 121 and second shell 122 together. Specifically, base 11 is installed at the same side of first contact part 1321.

A conductive plastic component is located between first terminal substrate 131 and second terminal substrate 132 to electrically connect first contact part 1321 and second contact part 1323. The conductive plastic component connects first contact part 1321 and second contact part 1323 in series, which shields the whole card edge connector from electromagnetic interference.

As shown in FIG. 3, to achieve a better effect of shielding electromagnetic interference, the conductive plastic component comprises a first conductive plastic 1311 matching with first contact part 1321 and a second conductive plastic matching with second contact part 1323. First conductive plastic 1311 is set with a structure on a side face to match with first contact part 1321, second conductive plastic 1323 is set with a structure on a side face to match with second contact part 1323.

As shown in FIG. 3, FIG. 5, and FIG. 7, one conductor group comprises at least a conductor. When a conductor group comprises a plurality of conductors, the distance between the adjacent conductors ranges from 0.1 mm to 1.2 mm.

The above description is preferred embodiments of this invention. In the scope of the claims, modifications and variations made by the person skilled in the art without creative work are within the scope of the invention.

The invention claimed is:

1. An orthogonal type card edge connector, comprising:

a terminal component for transmitting signal and/or current; and a shell subassembly for accommodating the terminal component;

wherein the terminal component comprises a first contact part and a second contact part located at two different ends of the terminal component, the first contact part is electrically connected to a first circuit board and the second contact part is electrically connected to a second orthogonal circuit board, the terminal component further comprises at least two terminal substrates with different layout structures, each terminal substrate is arranged with a plurality of conductor groups, two ends of each of the plurality of conductor groups are connected with the first contact part and the second contact part respectively, a shell subassembly further comprises at least two shell parts matching with the at least two terminal substrates, each terminal substrate is installed in one of the at least two shell parts, each shell part has a groove, a base is installed at an end of the shell subassembly, away from the groove of each shell part, the base fixes all the shell parts together.

2. An orthogonal type card edge connector of claim 1, wherein the first contact part is a contact spring pin, and the base is installed at the same side of the first contact part.

3. An orthogonal type card edge connector of claim 1, wherein the second contact part is a compression pin, and the compression pin has a fisheye structure.

4. An orthogonal type card edge connector of claim 3, further comprising a lead guide plate, installed at bottom of the shell subassembly to fix all the shell parts together, the lead guide plate is installed at the same side of the second contact part.

5. An orthogonal type card edge connector of claim 1, wherein the terminal component further comprises two terminal substrates, and the two terminal substrates have different layout structures.

6. An orthogonal type card edge connector of claim 5, wherein the layout structures are different in a width of the conductor groups, a gap between the conductor groups, a number of conductors in the conductor groups and/or a gap between the conductors in the conductor groups.

7. An orthogonal type card edge connector of claim 6, wherein the first contact part and the second contact part are set with current transmission contact points or signal transmission contact points, a width of the conductor groups connected with the current transmission contact points is wider than a width of the conductor groups connected with the signal transmission contact points.

8. A combination type card-plugged connector, comprising:

at least two orthogonal type card edge connectors of claim 1, a connection part, located at a front end face of the shell subassembly, a clamping plate engaged with the connection part, wherein the at least two orthogonal type card edge connectors are firmly connected together through the clamping plate, clamped on the connection part.

* * * * *